US008444006B2

(12) United States Patent
Dixon

(10) Patent No.: US 8,444,006 B2
(45) Date of Patent: May 21, 2013

(54) PACKET DISPENSER

(75) Inventor: Rodney Dixon, Burlington, NC (US)

(73) Assignee: MeadWestvaco Corporation, Richmond, VA (US)

( * ) Notice: Subject to any disclaimer, the term of this patent is extended or adjusted under 35 U.S.C. 154(b) by 584 days.

(21) Appl. No.: 12/295,377

(22) PCT Filed: Mar. 30, 2007

(86) PCT No.: PCT/US2007/007979
§ 371 (c)(1),
(2), (4) Date: Sep. 30, 2008

(87) PCT Pub. No.: WO2007/123734
PCT Pub. Date: Nov. 1, 2007

(65) Prior Publication Data

US 2009/0277918 A1 Nov. 12, 2009

Related U.S. Application Data

(60) Provisional application No. 60/787,297, filed on Mar. 30, 2006, provisional application No. 60/787,298, filed on Mar. 30, 2006.

(51) Int. Cl.
*B65D 83/08* (2006.01)
*B65D 83/04* (2006.01)

(52) U.S. Cl.
USPC ..... 221/26; 221/305; 221/312 C

(58) Field of Classification Search
USPC ..... 221/1, 25, 26, 30–33, 47, 63, 64
See application file for complete search history.

(56) References Cited

U.S. PATENT DOCUMENTS

| | | | | | |
|---|---|---|---|---|---|
| 1,286,038 | A | * | 11/1918 | Lowy | 229/125 |
| 2,338,041 | A | * | 12/1943 | King | 206/264 |
| 2,472,183 | A | * | 6/1949 | Williamson | 206/773 |
| 2,587,928 | A | * | 3/1952 | Tuck et al. | 221/25 |
| 2,758,710 | A | * | 8/1956 | Arens | 221/25 |
| 2,771,214 | A | * | 11/1956 | Lefebvre | 221/25 |
| 2,889,958 | A | * | 6/1959 | Svensson et al. | 221/25 |
| 2,984,397 | A | * | 5/1961 | Gillam | 225/49 |
| 3,115,989 | A | * | 12/1963 | Strang | 221/25 |
| 3,127,054 | A | | 3/1964 | Meyers | |

(Continued)

OTHER PUBLICATIONS

PCT International Search Report of PCT/US2007/007979 (PCT/ISA/210), Jan. 1, 2007, 3 pages.

*Primary Examiner* — Gene Grawford
*Assistant Examiner* — Kelvin L Randall, Jr.
(74) *Attorney, Agent, or Firm* — MWV Intellectual Property Group

(57) ABSTRACT

A dispensing container (12, 212) for housing and sequentially dispensing packets (124) is taught. Also taught are the carton blanks (10, 210) for erecting the respective containers. A length of packets created by severably attaching sequential packets (124) along respective tear lines (129) is rolled or folded then positioned within the container for later dispensing. Child-resistance features that impede removal of each packet (124) include routing the length of packets between opposing panels (16, 24) or between opposing panels and an edge of folded panels (224, 239) that exert a lateral pressure on the packets (124). In some embodiments the panels (16, 24) include apertures (64, 92) that catch or otherwise engage a feature of a packet, such as a blister, to further impede removal of each packet (124). To further impede removal of a packet (124), access notches (56, 256, 290) that allow the user to grasp the packet are narrowly constructed.

13 Claims, 12 Drawing Sheets

U.S. PATENT DOCUMENTS 3,266,055 A * 8/1966 Grayhill ..... 229/233
4,645,108 A * 2/1987 Gavin et al. ..... 225/106
6,347,704 B1 * 2/2002 Dixon ..... 206/459.5
6,702,108 B2 * 3/2004 Lo Duca ..... 206/232

* cited by examiner

PACKET DISPENSER

CROSS-REFERENCE TO RELATED APPLICATIONS

This application is a National Phase application of PCT Application PCT/US07/007979 filed Mar. 30, 2007, which claims the benefit of U.S. Provisional Application No. 60/787,298, filed Mar. 30, 2006 and U.S. Provisional Application No. 60/787,297, filed Mar. 30, 2006.

FIELD OF INVENTION

The present invention relates generally to apparatus and methods of dispensing items or products, and more specifically, to an apparatus and method for dispensing severably attached packets such as blisters, pouches, and the like.

BACKGROUND OF THE INVENTION

In the personal care industry, many types of containers have been developed for packaging a variety of items or products such as, unit dose medicants, pills, tablets, capsules, condoms, contact lenses, and the like. One typical type of packaging or packet is the conventional blister pack and another is the pouch. In a typical blister pack, a thermoforming technique is used to fabricate a plastic shell containing individual blisters or a tray of blisters for holding small consumable items. A backing sheet, generally comprising a foil material, is affixed to the back of the shell, thereby enclosing at least one item in a corresponding blister. To release an item from a blister, a user applies pressure to a blister forcing the item to rupture the backing sheet. The blister pack or a tray including items is often inserted within an outer sleeve for safely storing and protecting the items therein. The outer sleeve often includes child-resistant features, such as, locking mechanisms that are configured to releasably remove the blister pack or tray from the sleeve. A drawback of the conventional blister package is that when the blister pack or tray is lockably removed from the outer sleeve, the entire contents of the package is exposed, making all of the items available at once. Similar drawbacks exist with other types of packets.

Alternative dispensing containers have been designed for dispensing one or more packets. These conventional dispensing containers generally comprise a container including a chamber, a release slot, and a plurality of releasably attached packets that are folded or rolled and housed within the dispensing container. A packet is accessed by slideably removing the blister from the release slot. Generally, these dispensing containers are relatively expensive to manufacture because the containers generally include a plurality of complex parts that require additional time to manufacture and assemble. A further disadvantage of some dispensing containers is that they do not include child-resistant safety features. The packets can be continuously removed from the dispensing container and as a result, a child may continuously pull on the length of attached packets to gain access to all the packets at once.

It is desirable that packages holding consumable goods, such as pills or medicines packaged in packets, include child-resistant features that limit the amount of items being dispensed at one time. It is further desirable that the package be senior friendly to permit easy withdrawal of the package contents.

Accordingly, there remains in the art a need for a dispensing container that is inexpensive, light-weight, simple and easy to manufacture and assemble, and includes child-resistant safety features that require multiple coordinated motions for dispensing in a regulated manner. There is also a need for an apparatus that is senior friendly to permit easy withdrawal of the package contents with little manipulation, even if the user's manual dexterity or strength is reduced.

SUMMARY OF THE INVENTION

The present invention overcomes the deficiencies of the known art and the problems that remain unsolved by providing a dispensing container including a thumb notch that engages one edge of a blister for preventing one or more blisters from being withdrawn from the container. The thumb notch is detachably removed from the top of the dispensing container to expose one edge of a blister.

In another aspect, there is provided a dispensing container that meets the needs for child-resistance and senior friendliness by providing a dispensing container including a resilient panel and a blister aperture for receiving at least one blister of a blister strip. The resilient panel correspondingly aligns underneath the blister aperture to bias a blister through the blister aperture. An attempt to remove a blister from the dispensing container directs a blister to engage with an edge of the blister aperture, thereby frustrating the removal of the blister from the dispensing container. The blister strip includes a plurality of blisters including at least one item, each blister being connected to each other along a tear line for easily severing a blister from the blister strip. The blister strip is folded into an accordion and inserted within the dispensing container allowing a greater amount of blisters to be stored within the dispensing container, thereby utilizing less space. Pressure is applied to side panels of the dispensing container and a user simultaneously grasps and pulls the blister strip to sequentially dispense at least one blister at a time. The dispensing container includes security features which mandate the necessary coordination and combination of simultaneous actions by a user for removing at least one blister at a time.

In accordance with one embodiment of the present invention, there is provided a dispensing container comprising: a plurality of tabs and a plurality of panels operatively connected to each other to form a dispensing container, where a first panel includes a blister aperture, and where a second panel includes a thumb notch, a resilient panel and a third panel. The panels are foldably oriented so that the first panel is folded over the second panel so that the resilient panel correspondingly aligns with the blister aperture.

The dispensing container further includes a blister strip comprising a plurality of serially attached blisters where at least one blister contains at least one item, and where the blister strip is inserted between the first panel and the second panel so that one edge of a blister releasably engages with the thumb notch. The resilient panel biases the at least one blister through the blister aperture.

Advantageously, the blister strip is folded into an accordion and housed within the dispensing container. At least one panel includes an access notch for easily grasping and pulling a blister from the dispensing container.

Regarding the embodiments described herein, as well as those covered by the claims, the dispensing container may or may not be at least partially laminated to provide tear resistance and may be constructed of a cardboard, paperboard, plastic, or tear-resistant paperboard material. In addition, the dispensing container may be configured to include a variety of shapes and sizes and may or may not be reusable. Further, alternative package embodiments may or may not include information that is printed on any surface of the dispensing container or the blister strip, or both. Alternatively, the dispensing container may include an external panel with a pocket for housing or accommodating an insert comprising information. An example of the information may include dosage or product information, compliance instructions, coupons, promotional material, date; time, or any other information.

The invention includes a method of packaging items. In one embodiment the first step is cutting a blank from a substrate material, the blank comprising a plurality of tabs, and a plurality of panels operatively connected to each other; and wherein a first panel includes a blister aperture; and further wherein a second panel includes a thumb notch, a resilient panel and a third panel. The blank is then folded to form a dispensing container. A first panel is folded over the second panel so that the resilient panel correspondingly aligns with the blister aperture. The next step is forming a blister strip including a plurality of serially attached blisters and loading at least one item into at least one blister.

The method of packaging also includes inserting the blister strip between the first panel and the second panel where at least one blister extends through the blister aperture and one edge of the blister releasably engages with the thumb notch for preventing access to the at least one blister. A further step includes folding the blister strip into an accordion and housing the accordion folded blister strip within the dispensing container.

Another embodiment, of the present invention, includes a method of dispensing at least one item from a dispensing container. The first step is folding a blister strip including a plurality of serially attached blisters into an accordion where at least one blister holds at least one item. A further step includes sealing the accordion folded blister strip into the dispensing container where one edge of a blister releasably engages with a thumb notch. The next step is removing the thumb notch from the dispensing container, along perforated scores, for exposing one edge of a blister. A first access step includes applying pressure on a plurality of panels of the dispensing container so that a first panel bows upwardly for allowing a blister to clear an edge of a blister aperture formed within the first panel. A next access step includes simultaneously grasping and pulling at least one blister from the dispensing container and tearing the at least first blister along a tear line. The access steps are repeated for sequentially dispensing at least one blister at a time.

Optionally, the dispensing container may include indicators or indicia which may be printed on or formed within one or more of a plurality of panels for indicating to a user the location and/or direction a user should apply pressure on the dispensing container for withdrawing at least one blister from the dispensing container. Further, the dispensing container or blister strip may or may not include an indicator for indicating to a user when its time to consider replacing the container with additional blisters.

DETAILED DESCRIPTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model or pattern. The figures are not necessarily to scale and some features may be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Further, it will be understood that the present invention is applicable to the packaging, storing, and dispensing of various items or products. Accordingly, the terms, "item" or "product" as used herein includes all manner of small and portable items or products that are prepackaged or otherwise releasably attached that a user may wish to keep secure and dispense in a regulated manner.

Figure 1:
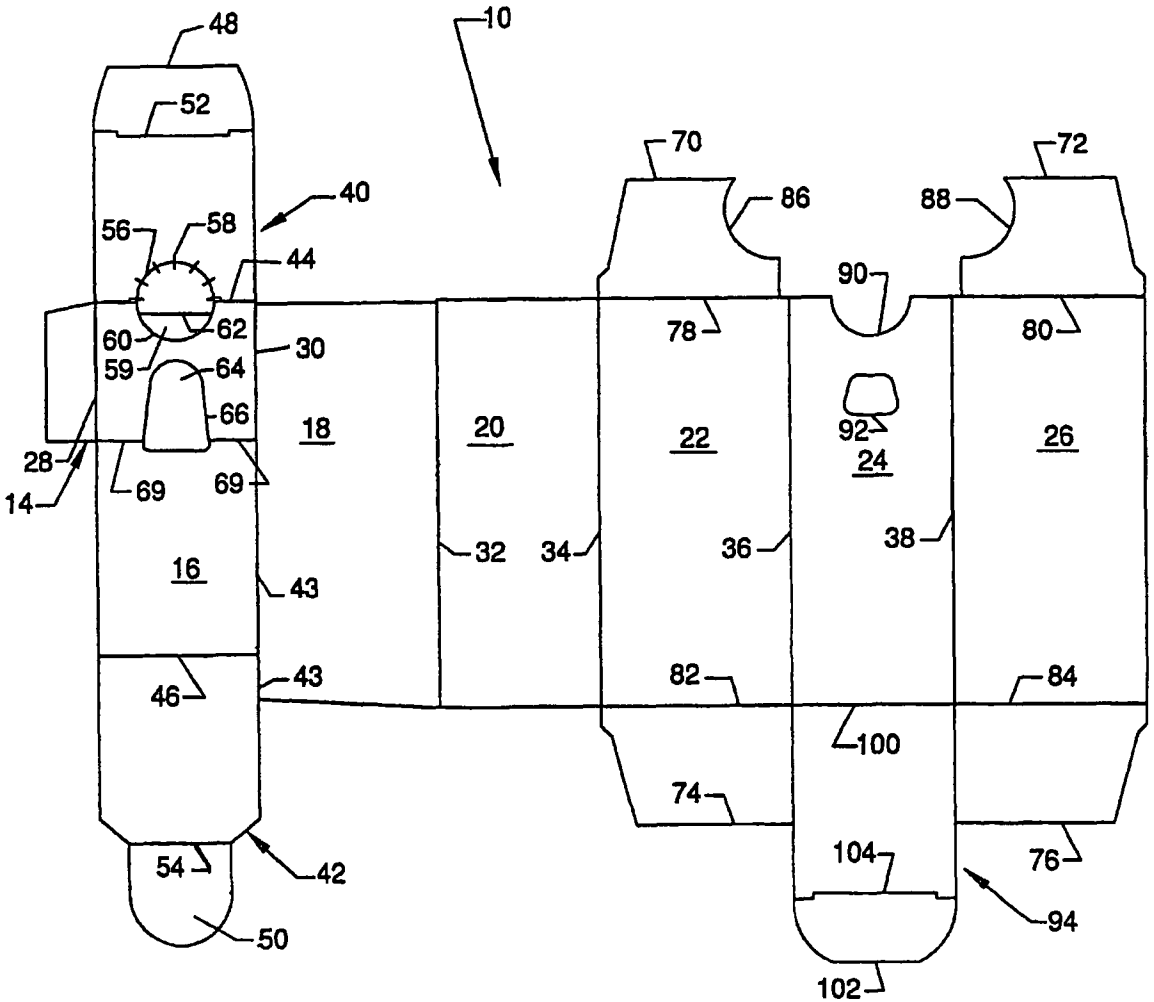
FIG. 1 is a plan view of an exemplary embodiment of a dispensing container blank, according to the present invention.
Figure 5:
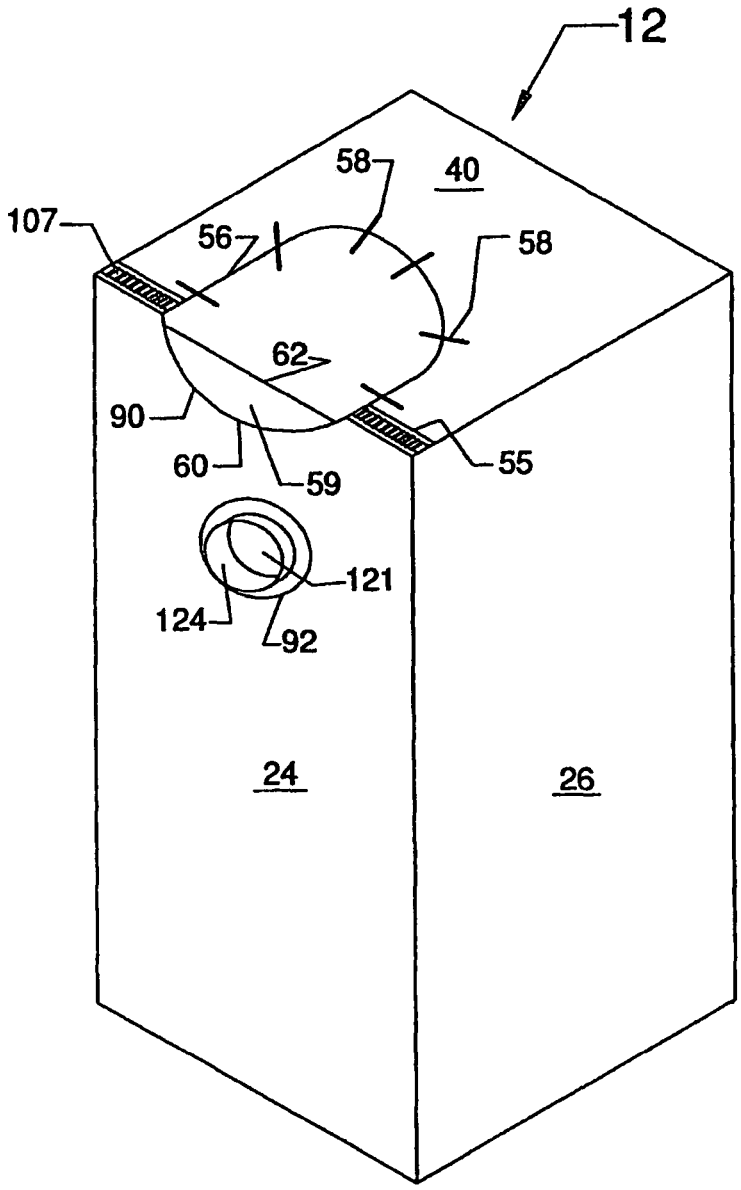
FIG. 5 is a perspective view of the dispensing container of FIG. 3 including a thumb notch for releasably securing the packet strip therein, according to the present invention.
Figure 6:
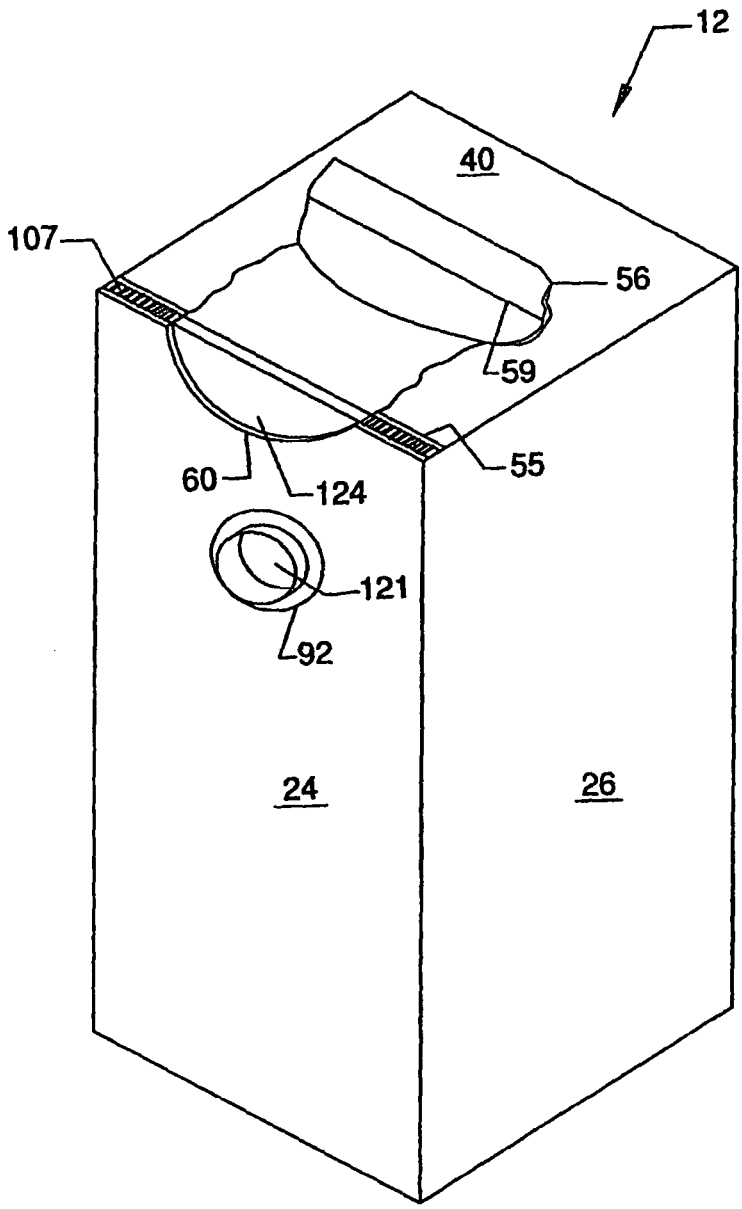
FIG. 6 is a perspective view of the dispensing container of FIG. 5 including the partially removed thumb notch, according to the present invention.

Referring now to the drawings, wherein like numbers represent like elements throughout, FIG. 1 is a plan view of an exemplary blank 10 for forming an embodiment of a dispensing container 12, best shown in FIGS. 5 and 6. Here, the illustrated blank 10 comprises an extension or glue panel 14, an inner panel 16, an inner side panel 18, a bottom panel 20, a first side panel 22, a top panel 24 and a second side panel 26. The panels 14, 16, 18, 20, 22, 24, and 26 are hingedly connected along fold lines 28, 30, 32, 34, 36, and 38, respectively.

The inner panel 16 is also hingedly connected to a first inner extension panel 40 and a second inner extension panel 42 along fold lines 44 and 46, respectively. The second inner extension panel 42 is severed from the inner side panel 18 along cut line 43. A first inner tab 48 and a second inner tab 60 are hingedly connected to the first inner extension panel 40 and the second inner extension panel 42 along fold lines 52 and 54, respectively. The inner panel 16 further includes a thumb notch 56 comprising a stop tab 59 that is defined by a full depth cut 60 and fold line 62. Thumb notch 56 is further defined by a frangible or severance line 58 for detachably removing the thumb notch 56. The inner panel 16 includes a feed aperture 64 that is defined by a full depth cut 66. Extending laterally from both sides of the feed aperture 64 are fold lines 69.

Each side panel 22, 26 includes a dust cover tab or top end tabs 70, 72 and a bottom end panel 74, 76 that are hingedly connected along fold lines 78, 80, 82 and 84, respectively. Each dust cover tab 70, 72 in the illustrated embodiment includes a recess 86 and 88, respectively.

Top panel 24 includes an access notch 90 that, here, correspondingly aligns with a blister aperture 92. As illustrated, blister aperture 92 extends completely through top panel 24. In alternative embodiments there is no blister aperture 92. The top panel 24 further includes a bottom extension panel 94. The bottom extension panel 94 is hingedly connected to the top panel 24 along fold line 100 and includes a bottom tab 102 that is hingedly connected along fold line 104.

The blank 10 may comprise paperboard, cardboard, plastic, tear-resistant paperboard or any combination thereof. The selection of this material may be made according to the packaging needs. At least a part of one or both side of the blank 10 may be laminated with a stiffing agent, such as a polymer film. In this manner, the exterior surface of the dispensing container is made more resistant to tearing. Optionally, this lamination may not extend over the entire surface of the blank 10 since only tear prone regions may require lamination. In certain embodiments, the material may be selected from biaxially oriented or cross-laminated polymetric films such as a high density polyethylene, polyolefins, polyesters or any combination thereof. In other embodiments, the lamination may be provided at stress points such as the package corners and exposed edges by applying one or more strips of the polymeric film, e.g. as a tape, over these areas.

Figure 2:
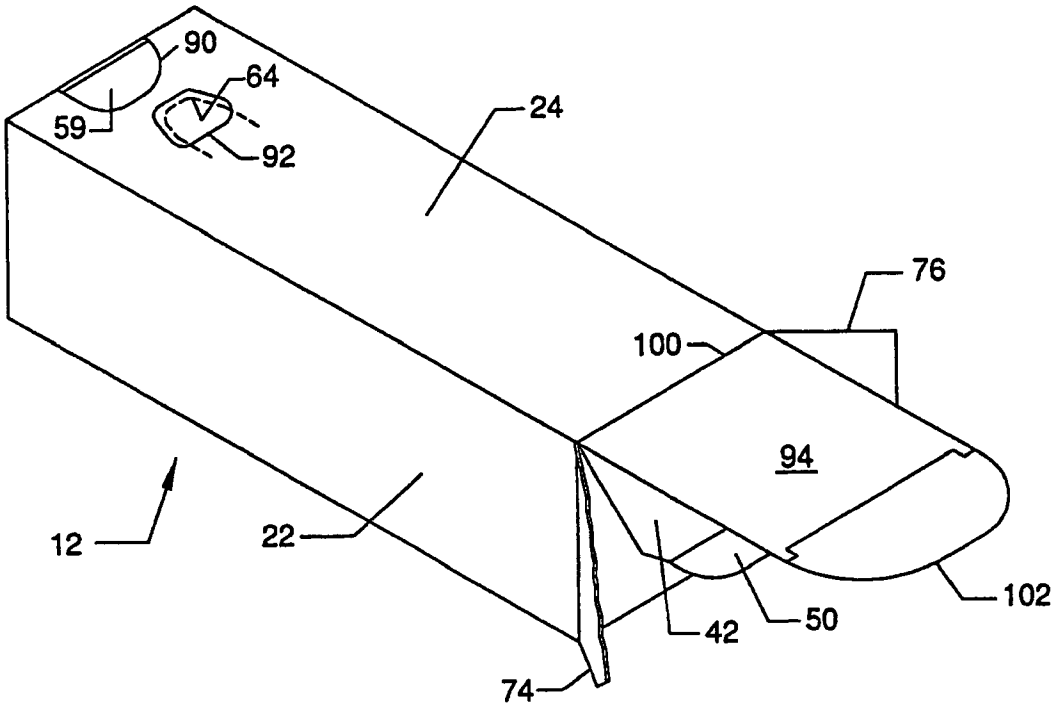
FIG. 2 is a perspective view of the partially erected blank of FIG. 1.

Turning now to the erection of the blank 10, FIG. 2 represents a substantially erected dispensing container 12 as described immediately below. It will be understood by those skilled in the art that the particular sequence of folds discussed below are neither limiting nor the only sequence of folds possible to erect the dispensing container 12 from the blank 10. With reference to both FIGS. 1 and 2, extension panel 14 is folded inwardly, that is, toward the reader along fold line 28. The inner panel 16, inner side panel 18, and bottom panel 20 are also folded inwardly along fold lines 30, 32, and 34, respectively. The back of extension panel 14 is then attached to the face of the first side panel 22 along the fold line 36, such that the fold lines 28, 36 are adjacent and parallel. The top panel 24 and the second side panel 26 are then folded inwardly along the remaining fold lines 36, 38 so that the faces of the top panel 24 and second side panel 26 can be attached to the backs of inner panel 16 and inner side panel 18. The panels may be attached using any suitable means for attaching including adhesive, interlocking panels, and mechanical fasteners, as understood by those skilled in the art.

Continuing the folding sequence of the illustrated dispensing container 12, the top dust covers 70, 72 are folded downwardly along fold lines 78, 80 and oriented in a general horizontal position thereby closing the void and partially forming the top end wall of dispensing container 12. The first inner extension panel 40 and the first inner tab 48 are likewise folded downwardly along fold lines 44 and 52, respectively. The first inner tab 48 is inserted within a recess defined by the edges of dust covers 70, 72 and a lateral top edge of bottom panel 20. Here, recesses 86 and 88 combine to form a semi-circular arch that correspondingly aligns with the semi-circular arch of thumb notch 56. The first inner extension panel 40, or the first inner tab 48, or both, may be adhesively attached to tabs 70, 72 or to the inner surface of bottom panel 20.

When erected, the back of the inner panel 16 rests against the face of the top panel 24 so that the feed aperture 64 is under the blister aperture 92. The inner panel 16 and the top panel 24 combine to form a channel 55 for slideably receiving a blister strip 108, as shown in FIGS. 5 and 6. Before continuing with a description of the erecting of the dispenser 12, we turn to a description of the exemplary packet strip 108.

Figure 3:
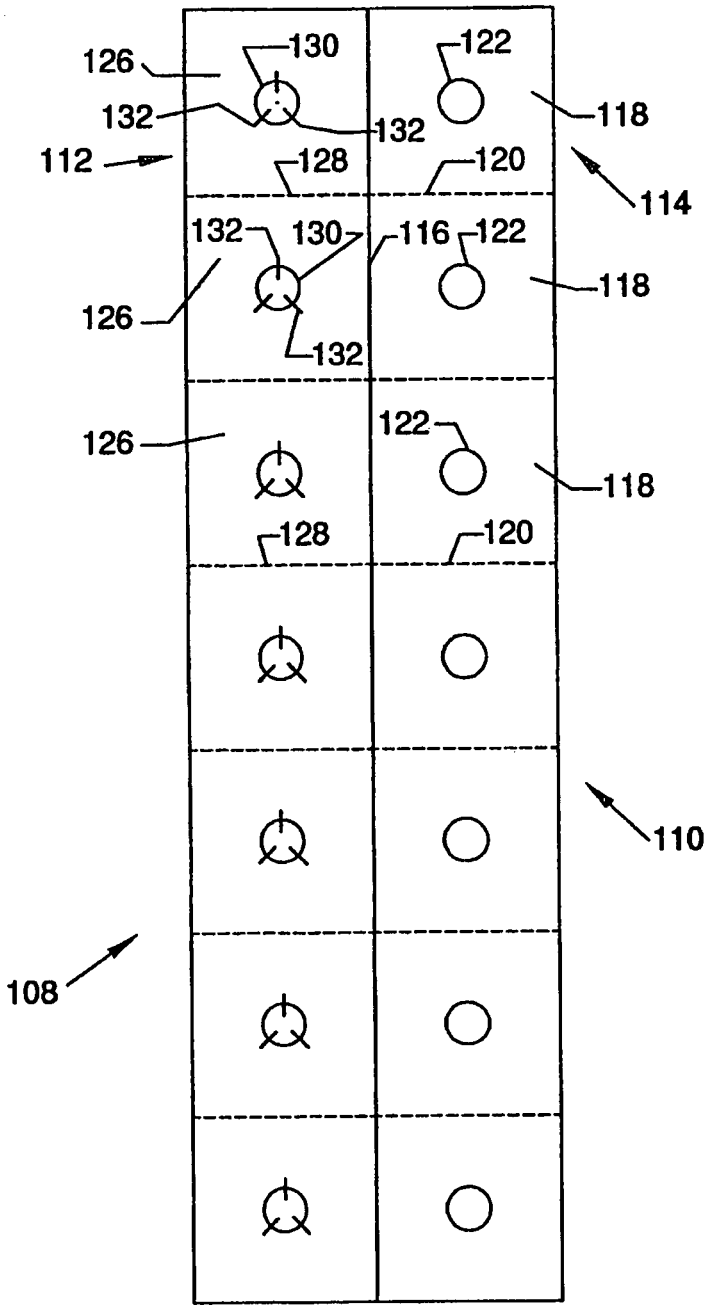
FIG. 3 is a plan view of an exemplary embodiment of a packet blank, according to the present invention.

Referring now to FIG. 3 there is illustrated an embodiment of severably attached packets in the form of a blister strip blank 110, for forming an embodiment of a blister strip 108. The blister strip blank 110 comprises a back panel 112 that is hingedly connected to a front panel 114 along a longitudinal fold line 116. The front panel 114 includes a plurality of front sections 118 that are severably connected to each other along tear lines 120. Each front section 118 includes at least one aperture 122 for receiving an item-containing blister 124, best shown in FIG. 4.

Figure 7:
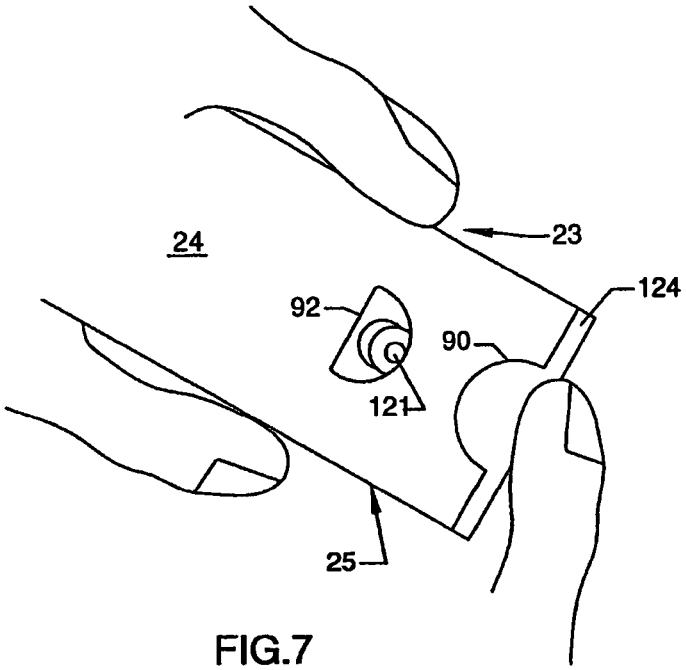
FIGS. 7 and 8 show perspective views of the dispensing container of FIG. 6, according to the present invention, showing a sequence of steps for dispensing one packet at a time.
Figure 8:
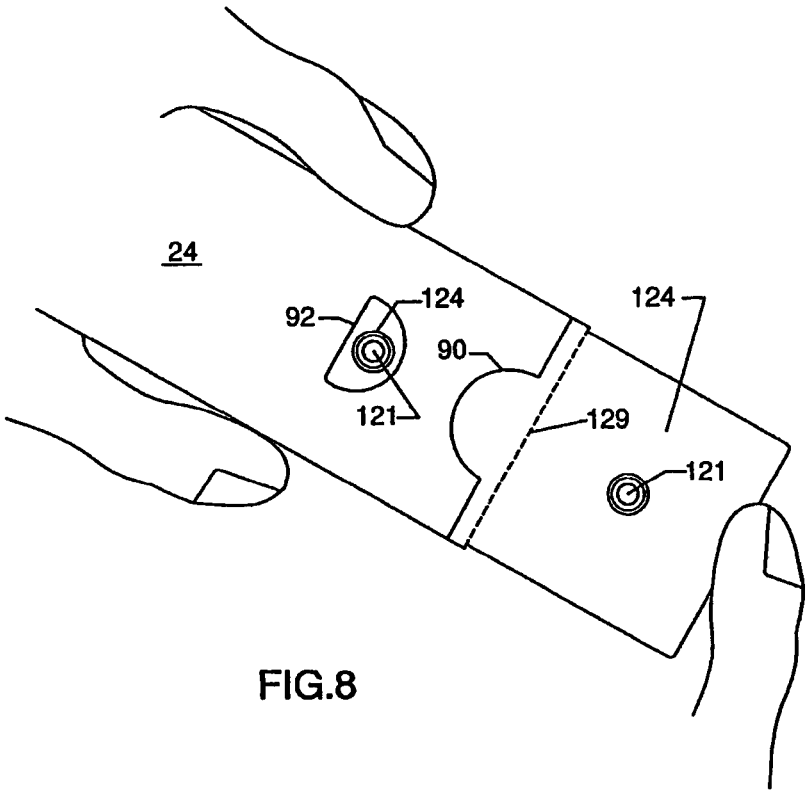

Continuing with FIG. 3, the back panel 112 includes a plurality of back sections 126 that are severably connected to each other along tear lines 128. As shown, each back section 126 correspondingly aligns with the aperture 122 of the adjacent front section 118 along the fold line 116. Each back section 126 includes at least one dispensing aperture 130 that is defined by a plurality of perforated scores 132 formed within the substrate of back panel 112. Tear lines 120 and 128 combine to form a frangible line 129, best illustrated in FIG. 4. The width of the blister strip 108 is slightly smaller than the width of the feed aperture 64 so that the blister strips 108 can removably slide within dispensing container 12 and through the channel 55, as shown in FIGS. 7 and 8.

Turning now to the configuration of the blister strip 108, one or more blisters 124 are disposed between a corresponding front section 118 and a corresponding back section 126. The one or more blisters 124 hold at least one or more items 121. Each blister 124 extends through a corresponding aperture 122. The back panel 112 is folded along fold line 116 and securely attached to the front panel 118. At least one blister 124 is securely sandwiched between a corresponding back section 126 and front section 118. The blister strip blank 110 may be fabricated from paperboard, cardboard, plastic, tear-resistant paperboard or any combination thereof, and the like. Each blister 124 may be transparent for allowing a viewer to easily identify the item disposed within the blister 124 or opaque for preventing a viewer from seeing the contents therein.

In some embodiments the severably attached packets are folded and inserted within the dispenser 12, while in other embodiments the packets are rolled and inserted within the dispenser 12.

Figure 4:
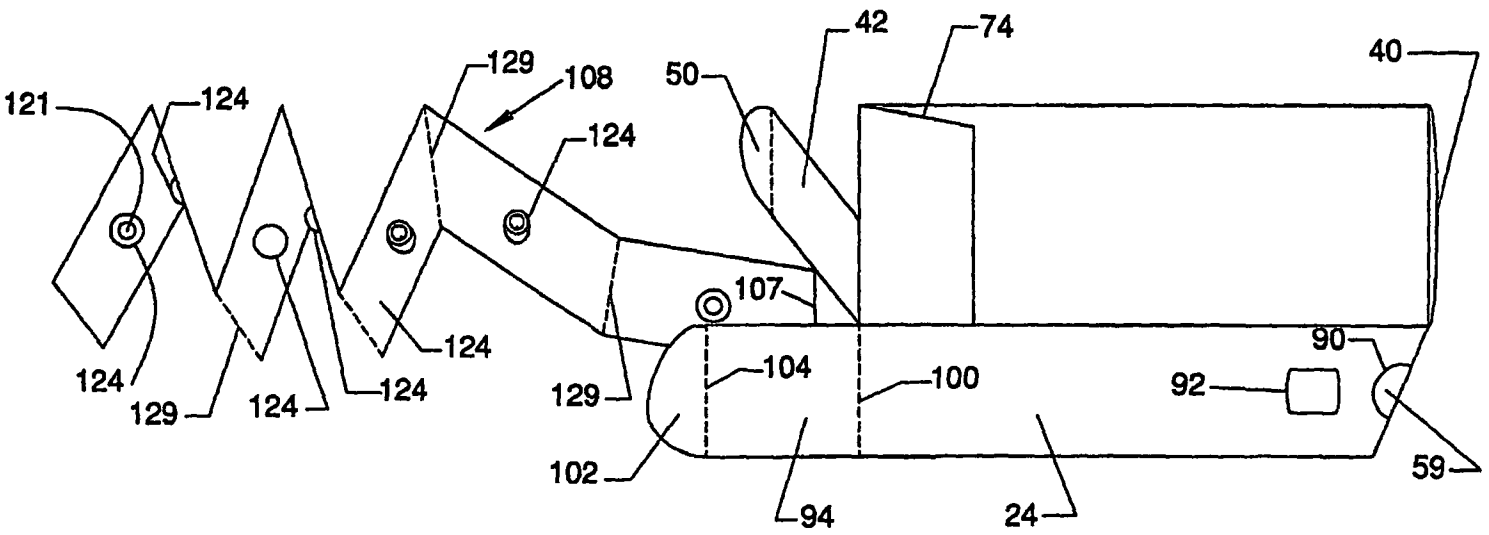
FIG. 4 is a plan view of a folded packet strip being inserted within the dispensing container, according to the present invention.

Turning now to FIGS. 4 and 5, in loading the illustrated rolled or folded severably detached packets into the dispenser 12, the packets are inserted through the open end and the first packet or a leader of some kind is threaded through the back of the feed aperture 64 and placed so that the leading edge of the first packet or leader rests immediately below the thumb notch 56. The inner extension panel 42 and the bottom extension panel 94 can now be folded to form the bottom end wall and line the container 12.

Regarding those embodiments that are loaded with a blister strip and include a blister aperture 92, the blister strip may be loaded outwardly such that a blister 124 is captured by the aperture 92, as best shown in FIGS. 5 and 6. Regarding those embodiments without a blister aperture, the blister strip may be loaded inwardly such that a blister 124 is captured by the feed aperture 64. Capturing a blister 124 with either the blister aperture 92 or feed aperture 64 creates a child resistant feature as explained below. In all embodiments, it is recommended that in loading the packets the leading portion or first edge 107, after being threaded through the aperture 64 and between the inner panel 16 and top panel 24, be positioned so that it is accessible after removing the thumb notch 56, as also explained immediately below.

Turning now to FIGS. 5 and 6, thumb notch 56 is detached along the severance lines 58, 60 thereby exposing an edge 107 of a blister 124, as illustrated in FIG. 6. Thumb notch 56 may comprise any shape or size and is aligned in combination with recesses 86, 88, and access notch 90 to form an access area for grasping and pulling a blister 124 from the dispensing container 12. In some embodiments where the blisters are loaded to face outwardly, an attempt to pull a blister 124 from the dispensing container 12 is frustrated by the blister 124 engaging with the edge of the blister aperture 92. Therefore, even if thumb notch 56 is torn open, removed or compromised, engagement of a blister 124 with the edge of the blister aperture 92 provides a child-resistant feature that prevents a child from gaining immediate access to the items 121. Thus, thumb notch 56 and blister aperture 92 cooperate to provide a child-resistant feature. In other embodiments where the blisters are loaded to face inwardly an attempt to pull a blister 124 from the dispensing container 12 is frustrated by the blister 124 engaging the edge of the feed aperture 64. Thus, thumb notch 56 and feed aperture 64 cooperate to provide a child-resistant feature.

Referring now to FIGS. 7 and 8 there is illustrated of a dispensing container 12, according to the present invention, showing a sequence of one method for dispensing at least one blister 124. To remove a blister 124 from the dispensing container 12, a user, using a finger and thumb of one hand, applies pressure along the first and second side panels 22, 26, near top edges 23, 25 of top panel 24. The applied pressure forces the top panel 24 to bow upwardly so that the blister 124 disengages with or clears the circumferential edge of the blister aperture 92. As pressure is being applied, the user simultaneously grasps a blister 124, using a finger and thumb of the other hand, via, access notch 90, and pulls the blister 124 outwards from dispensing container 12. As one blister 124 slides out of the dispensing container 12, a second, severably attached blister 124 moves forward. Another method for disengaging the blister 124 is to push inwardly on the face of the blister 124 until it is below the edge of the blister aperture 92. In those embodiments where the blisters 124 engage the feed aperture 64, the user inserts a finger through the thumb notch 56 to press the face of the blister 124 inwardly toward the top panel 24 while grasping the edge 107 or blister 124 and lifting or pulling the blister through the thumb notch 56.

The exposed blister 124 may then be severed or detached along a tear line 129. To remove an item 121 from the separated blister 124, pressure is applied to the blister 124 forcing the item 121 to tear the protective backing, as is well understood. The dispensing container 12 may or may not include a tear guide or blade that is connected to one of the panels 16 or 24 to help tear the blister 124 along the tear line 129. Further, the dispensing container may or may not be transparent and may be reusable or disposable.

Next, and with reference to FIGS. 9-13, there is illustrated a second embodiment of the present invention. Because the first illustrated embodiment shares many common elements with the second illustrated embodiment, the common elements that appear in the second embodiment have been labeled with the same element numbers as the first illustrated embodiment except that the prefix "2" or "3" has been inserted. For example, the bottom panel 20 first shown in FIG. 1 is substantially the same element as bottom panel 220 first shown in FIG. 9 so both panels have in common the initial element designation of "20". Use of this numbering convention should allow a quick and ready understanding of the second embodiment without unnecessary repetition of the teaching above.

Figure 9:
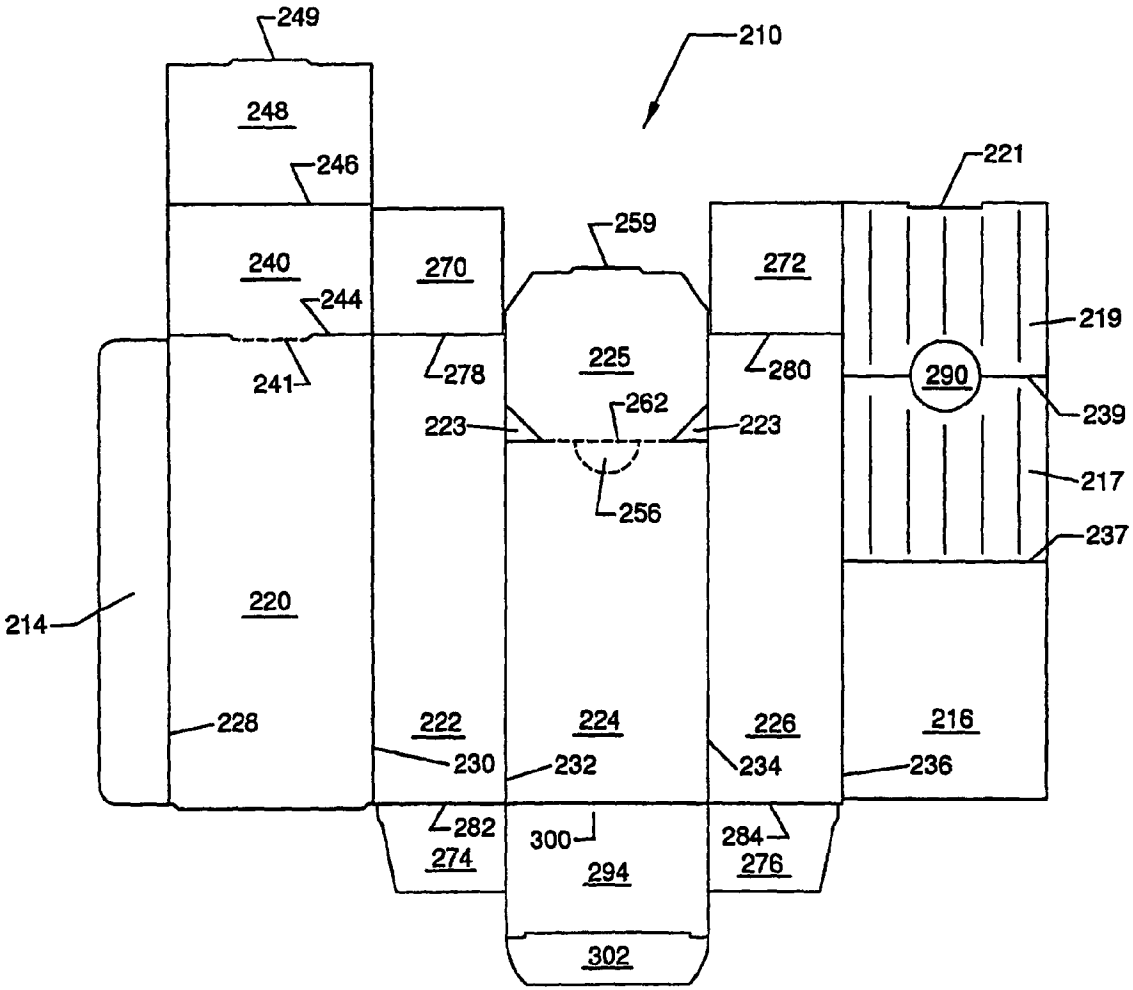
FIG. 9 is a plan view of an exemplary embodiment of an alternative dispensing container blank, according to the present invention.
Figure 13:
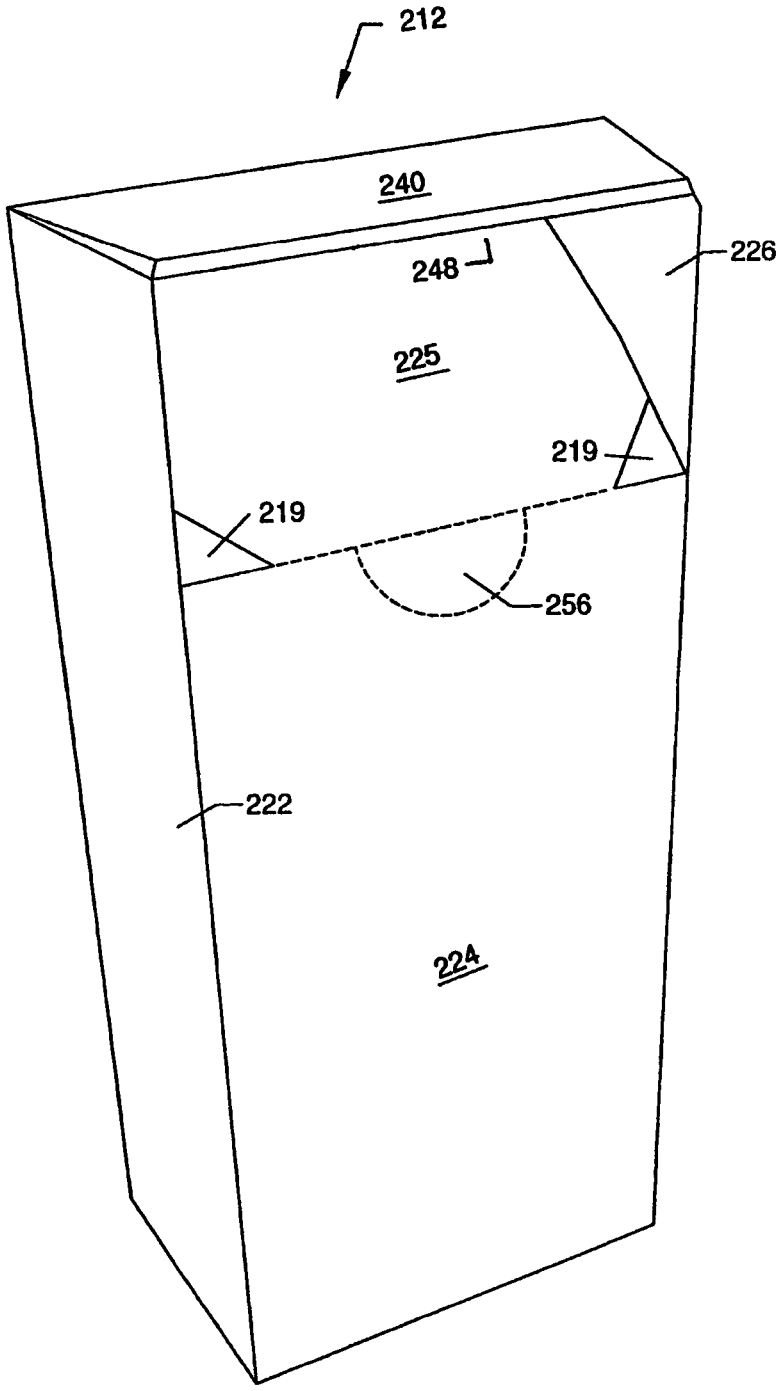
FIG. 13 is a perspective view of the exemplary dispenser erected from the blank of FIG. 9, according to the present invention.

Turning now to FIG. 9, there is shown a plan view of an exemplary blank 210 for forming an embodiment of a dispensing container 212, best shown in FIG. 13. Here the illustrated blank 210 comprises an extension or glue panel 214, an inner panel 216 including an inner wall section 217 and top wall section 219, a bottom panel 220, a first side panel 222, a top panel 224, and a second side panel 226. The panels 214, 220, 222, 224, 226 and 216 are hingedly connected along fold lines 228, 230, 232, 234 and 236, respectively. The inner wall section 217 is hingedly connected to the inner panel 216 along a first fold line 237 and along a second fold line 239 to the top wall section 219 that also includes a receiving notch 221.

The bottom panel 220 is hingedly attached to an outer end wall panel 240 along a receiving notch 241 and a fold line 244, which in turn is hingedly connected to an inner end wall panel 248 along a fold line 246. An engaging tab 249 is located at the distal edge of the inner end wall panel 248. The top panel 224 is hingedly attached to a removable top wall 225 along a severance line 262 and includes a removable thumb notch 256. Adjacent to the top wall 225 and top panel 224 are removed sections 223. An engaging tab 250 is positioned along the top wall 225. At the opposite end of the top panel 224 is foldably attached a bottom wall tab 294 along a fold line 300, and to the bottom wall tab 294 is foldably attached a bottom tab 302. The side panels 222, 226 are each hingedly connected to top dust cover tabs 270, 272 and bottom dust cover tabs 274, 276, along respective fold lines 278, 280, 282, 284. The inner panel 216 further includes an access notch 290, positioned to span both the inner wall section 217 and top wall section 219.

Figure 10:
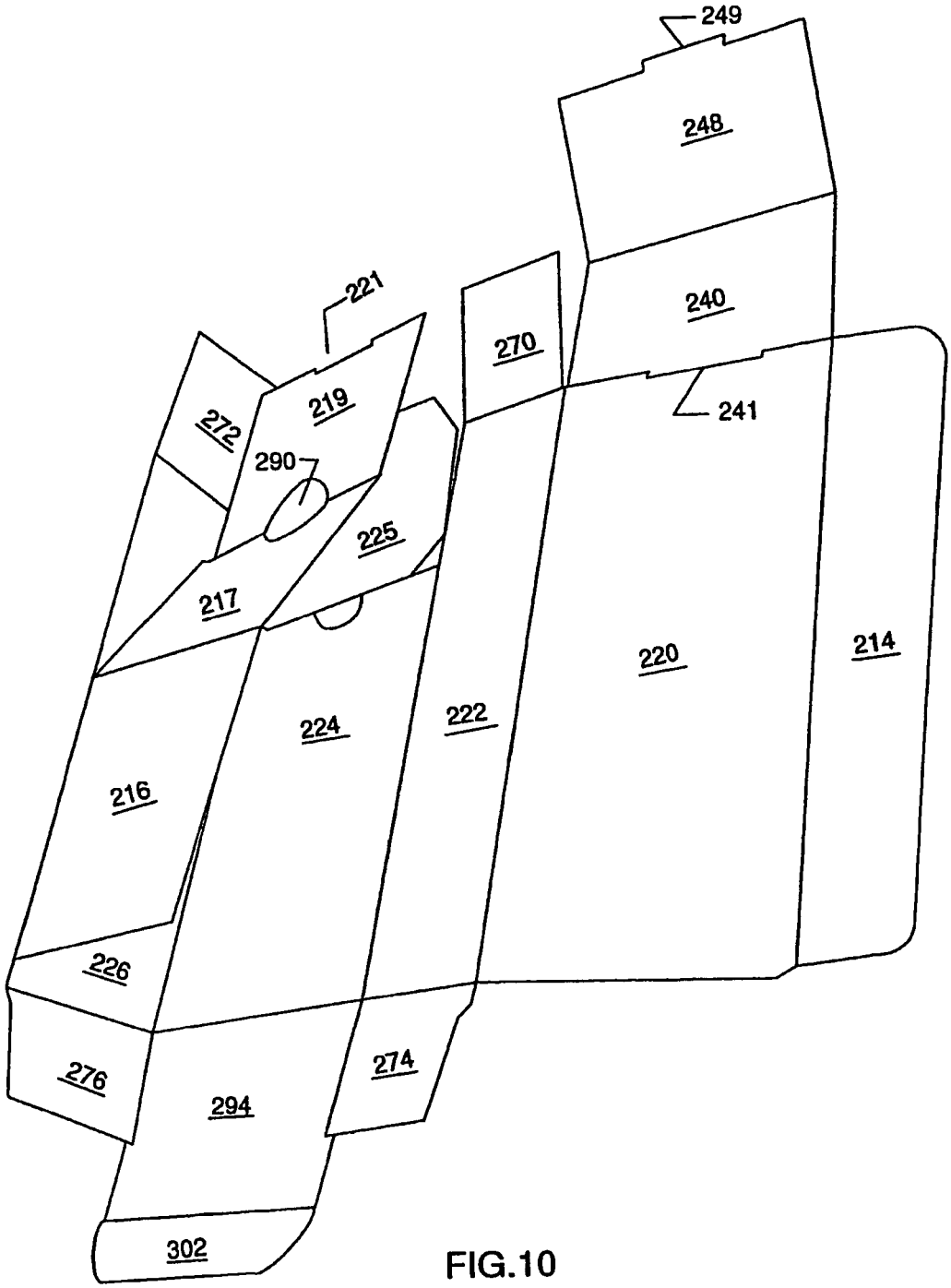
FIG. 10 is a perspective view of the partially erected blank of FIG. 9.
Figure 11:
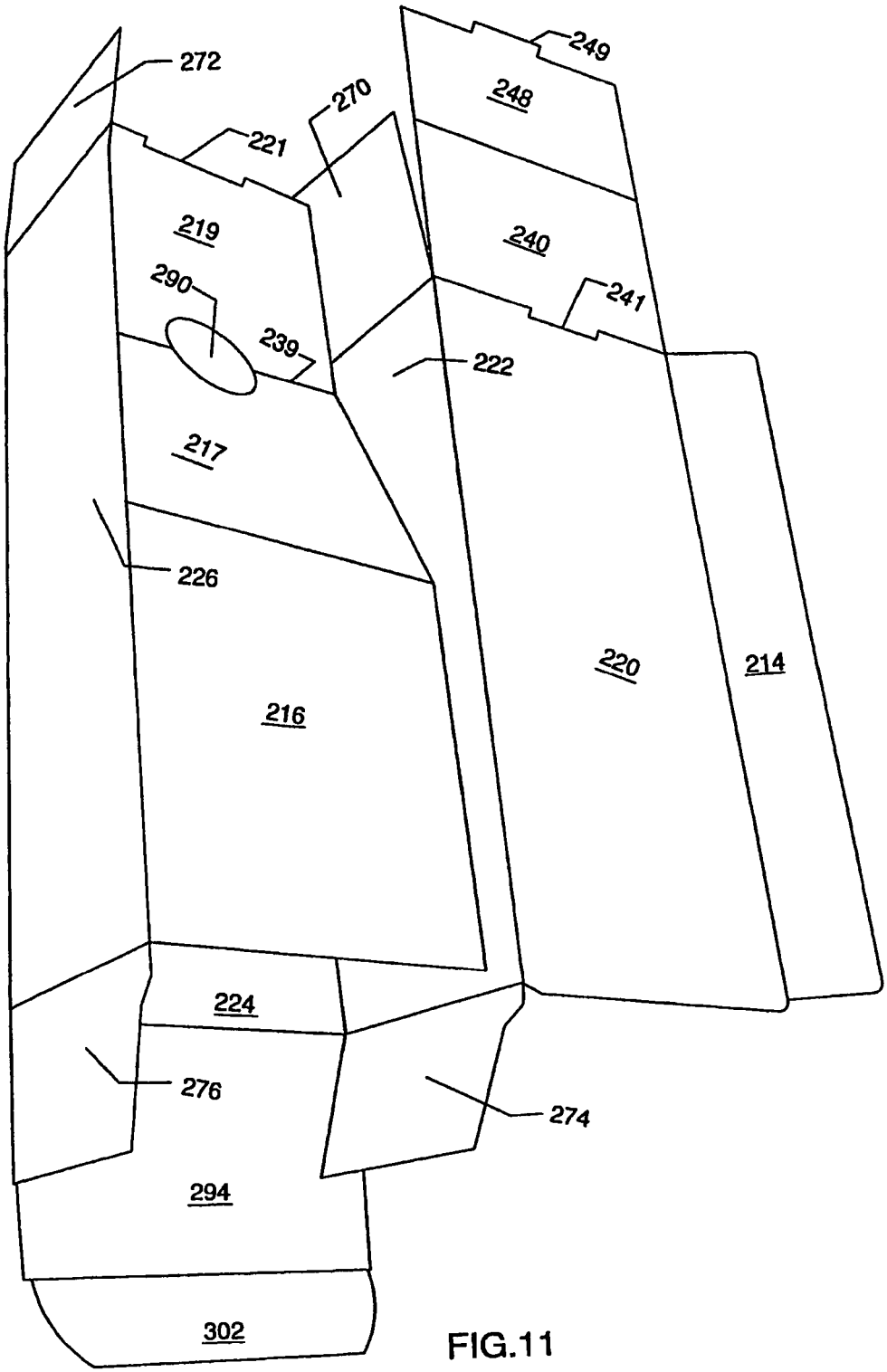
FIG. 11 is a perspective view of the further erected blank of FIG. 10.

Turning now to an exemplary sequence for erecting the illustrated dispenser 212 from the illustrated blank 210, the inner panel 216 is folded and positioned substantially parallel to the top panel 224, as best illustrated in FIG. 10. Note that in FIG. 11 the inner wall section 217 has been folded inwardly such that the fold line 239 contacts the top panel 224 and forms an angled inner wall. Subsequently, the bottom panel 220 is folded and positioned to overlap the inner panel 216 and the glue panel 214 is attached to the side panel 226 to form a tubular carton. At this time or later, the severably attached packets 108 can be loaded into the cavity created by the opposing side walls 222, 226 and opposing inner panel 216 and top panel 224, and the leading edge 107 of the first packet can be threaded between the fold line 239 and top panel 224. Thereafter, the end can be closed by folding the bottom dust cover tabs 274, 276 and bottom wall tab 294 and bottom tab 302.

Figure 12:
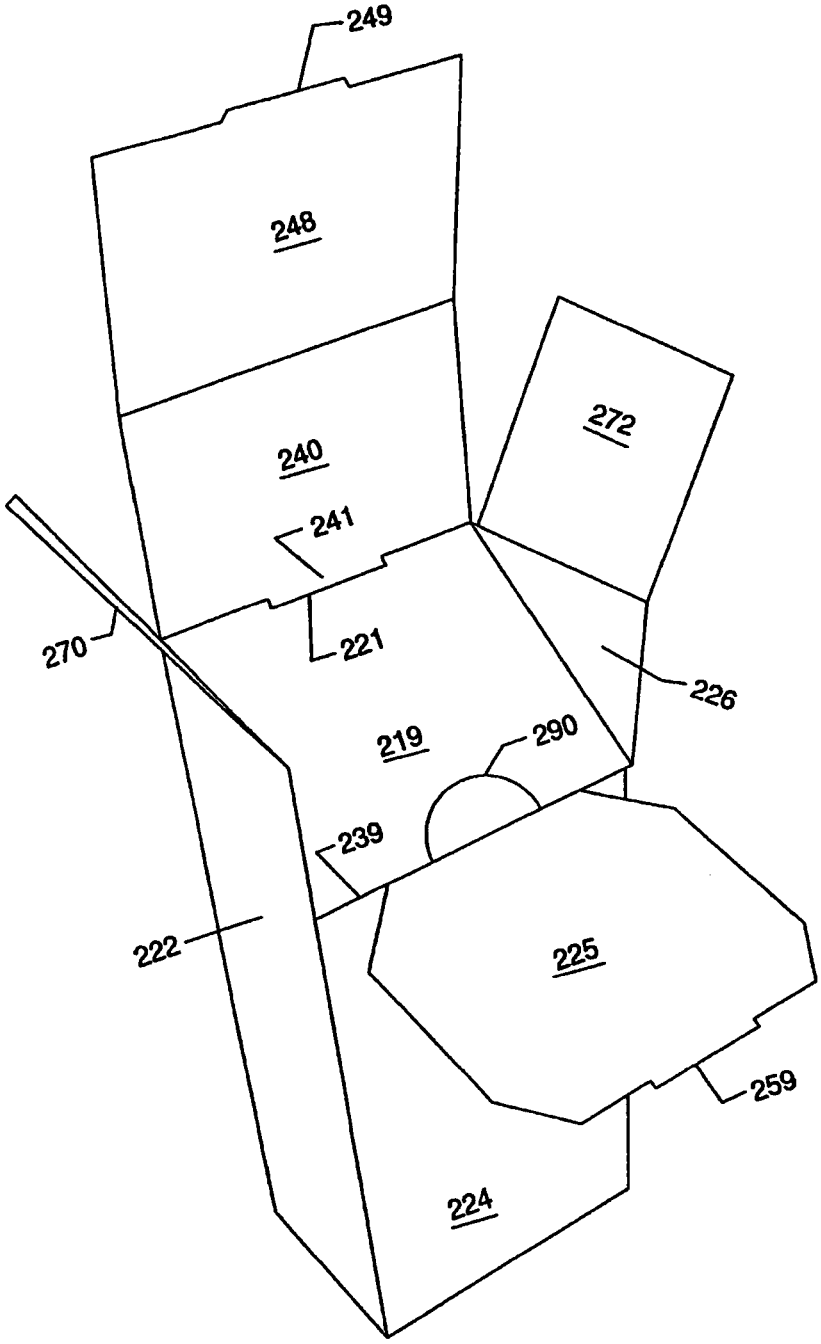
FIG. 12 is a perspective view of the further erected blank of FIG. 11.

Turning now to FIG. 12, there is shown the top wall section 219 folded such that the respective receiving notches 221, 241 are immediately adjacent and positioned to collectively receive the respective engaging tabs 249, 259. This configuration of an angled inner wall section 217 and angled top wall section 219 urges the common edge, identified by the fold line 239, against the inside of the top panel 224 to hamper or otherwise restrict the withdrawal of a packet from the dispenser 212. The removable top wall 225 is then folded over the top wall section 219 and the engaging tab 259 is inserted in the receiving notch 241 so as to also matingly engage the receiving notch 221.

With reference now to FIGS. 12 and 13, the top end wall is completed and the dispenser 212 completely erected by folding the top dust tabs 270, 272 inwardly and then the outer end wall panel 240 downwardly to cover the dust tabs 270, 272. Thereafter, the inner end wall panel 248 is folded under the dust tabs 270, 272 and the engaging tab 249 inserted into the receiving notch 241 together with the removable top wall engaging tab 259.

In practice, a user accesses the contents of the dispenser 212 by severing the thumb notch 256 and pulling off the removable top wall 225 to expose the leading edge 107 of a packet 124 captured between the folded edge 239 and top panel 224. In some embodiments the top wall 225 can be configured to remain as an additional impediment to access. The amount of lateral force exerted by the folded edge 239 against the packet 124 is largely determined by the pressure exerted by the folded inner wall section 217 and top wall section 219. Removing a packet 124 requires the user to insert a finger or tool through the narrow access notch 290, grasp the small amount of exposed packet 124—typically, but not necessarily, between a finger positioned through the access notch 290 and a thumb position over the thumb notch 256, and pull the packet 124 with sufficient force to overcome the lateral pressure exerted by the folded edge 239 without allowing the packet 124 to slip. This combination of lateral pressure against the packet 124 and narrow access cooperate to provide a child-resistant feature As taught by the illustrated embodiments, the child-resistant features include coordinated motions to overcome the restricted dispensing of packets. Some embodiments include restricting access by capturing packets between adjacent panels and engaging a blister packet from a feed aperture 64 or blister aperture 92 while simultaneously pulling a blister 124 from the dispensing container 12 for sequentially dispensing one blister 124 at a time, while other embodiments include restricting access by capturing packets between adjacent panels that apply an external force—without fully engaging an adjacent packet—which frustrates removal of the packet from the dispenser 12. Other embodiments include combinations of these features.

The law does not require and it is economically prohibitive to illustrate and teach every possible embodiment of the present claims. Hence, the above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed:

1. A packet dispenser, comprising:

a plurality of panels and tabs operatively connected to each other to form a container, wherein the plurality of panels and tabs include an inner panel and an outer panel positioned over an outer surface of a first portion of the inner panel to form a channel between the outer panel and the first portion of the inner panel, the channel having an outlet at an exit end of the outer panel, the outer panel including an outer access notch along the exit end of the outer panel; and a length of attached packets, each of the packets having a blister containing at least one item, wherein said packets are housed within said container, wherein at least one of the attached packets is received in the channel for sliding movement toward the outlet, the at least one of the attached packets being exposed at least in part through the outer access notch to facilitate access to the attached packets, wherein the inner panel includes a second portion connected to the first portion by a first fold line, the second portion extending away from the channel, wherein the inner panel further includes a third portion connected to the first portion by a second fold line that is disposed opposite to the first fold line, the third portion being disposed substantially perpendicularly to the first portion, the third portion comprising a removable thumb notch element that defines at least in part an inner access notch in the first portion of the inner panel, the inner access notch being disposed in substantial alignment with the outer access notch.

2. The packet dispenser of claim 1, wherein the length of the attached packets is folded into an accordion so as to allow a greater number of the attached packets to be stored within the container.

3. The packet dispenser of claim 1, wherein the first portion of the inner panel includes a feed aperture disposed in substantial registry with the blister of the at least one of the attached packets.

4. The packet dispenser of claim 3, wherein the outer panel includes a blister aperture for capturing the blister of the at least one of attached packets, the blister aperture being spaced apart from the inner access notch such that the blister aperture is positioned upstream of the inner access notch with respect to a line of the sliding movement of the at least one of the attached packets.

5. The packet dispenser of claim 3, wherein the feed aperture is spaced apart from the inner access notch such that the feed aperture is positioned upstream of the inner access notch with respect to a line of the sliding movement of the at least one of the attached packets.

6. The packet dispenser of claim 1, wherein the inner access notch extends into the third, portion of the inner panel when the removable thumb notch element is removed from the third portion, and wherein the plurality of panels and tabs further include at least one dust cover that is disposed under the third portion of the inner panel, the at least one dust cover including a recess that is positioned in substantial alignment with part of the inner access notch that extends into the third portion of the inner panel.

7. The packet dispenser of claim 1, wherein the inner panel is of a one-piece structure and has a stopper tab formed at least partially from part of the first portion of the inner panel to define at least in part the inner access notch in the first portion of the inner panel, and wherein the stopper tab is disposed at the outlet to at least partially close the outlet.

8. The packet dispenser of claim 7, wherein the stopper tab is removably connected to the inner panel.

9. The packet dispenser of claim 8, wherein the stopper tab is provided by the thumb notch element that is removably connected to the third portion of the inner panel.

10. A packet dispenser, comprising:

a plurality of panels and tabs operatively connected to each other to form a container, wherein the plurality of panels and tabs include an inner panel and an outer panel positioned over an outer surface of a portion of the inner panel to form a channel between the outer panel and the first portion of the inner panel, the channel having an outlet at an exit end of the outer panel, the outer panel including an outer access notch along the exit end of the outer panel; and a length of attached packets, each of the packets having a blister containing at least one item, wherein said packets are housed within said container, wherein at least one of the attached packets is received in the channel for sliding movement toward the outlet, the at least one of the attached packets being exposed at least in part through the outer access notch to facilitate access to the attached packets, wherein the inner panel further includes a second portion connected to the first portion by a fold line, the second portion being disposed substantially perpendicularly to the first portion, the second portion comprising a removable thumb notch element that defines at least in part an inner access notch in the first portion of the inner panel, the inner access notch being disposed in substantial alignment with the outer access notch, wherein the inner access notch extends into the second portion of the inner panel, the plurality of panels and tabs further include at least one dust cover that is disposed under the second portion of the inner panel, the at least one dust cover including a recess that is positioned in substantial alignment with part of the inner access notch that extends into the second portion of the inner panel.

11. The packet dispenser of claim 10, wherein the plurality of panels and tabs further include at least three primary panels that cooperate with the outer panel to form a sleeve structure, and the at least one dust cover is connected to at least one of the three primary panels, the at least one dust cover and the second portion of the inner panel together provide an end closure for closing one end of the sleeve structure.

12. The packet dispenser of claim 11, wherein the plurality of panels and tabs further include an inner side panel connected to the sleeve structure along a fold line, and the first portion of the inner panel is connected to the sleeve structure through the inner side panel.

13. The packet dispenser of claim 12, wherein the plurality of panels and tabs further include a glue panel connected to the first portion of the inner panel by a fold line, the glue panel being secured to an inside surface of said at least one of the three primary panels to fix the first portion of the inner panel with respect to the outer panel.

* * * * *